US005890822A

United States Patent [19]

Saikawa et al.

[11] Patent Number: 5,890,822

[45] Date of Patent: Apr. 6, 1999

[54] IMAGE FORMING APPARATUS

[75] Inventors: Satoshi Saikawa, Ichikawa; Sanko Yamaguchi, Saga, both of Japan

[73] Assignee: Canon Kabushiki Kaisha, Tokyo, Japan

[21] Appl. No.: 838,809

[22] Filed: Apr. 10, 1997

[30] Foreign Application Priority Data

Apr. 12, 1996 [JP] Japan ..... 8-091035

[51] Int. Cl.[6] ..... B41J 13/18

[52] U.S. Cl. ..... 400/647.1; 101/419; 271/189

[58] Field of Search ..... 400/628, 629, 400/646, 647, 647.1; 101/416, 417, 418, 419, 420; 271/188, 189, 192, 209, 213, 214

[56] References Cited

U.S. PATENT DOCUMENTS

| | | | |
|---|---|---|---|
| 4,794,859 | 1/1989 | Huseby et al. | 101/485 |
| 4,844,633 | 7/1989 | Greenberg | 400/120 |
| 5,324,020 | 6/1994 | Rasmussen et al. | 400/647.1 |
| 5,435,541 | 7/1995 | Fornay et al. | 271/189 |
| 5,451,044 | 9/1995 | Nakayama | 271/189 |
| 5,520,382 | 5/1996 | Nakajima | 271/188 |
| 5,603,493 | 2/1997 | Kelly | 271/188 |

FOREIGN PATENT DOCUMENTS

| | | | |
|---|---|---|---|
| 559553 | 9/1993 | European Pat. Off. | 271/213 |
| 211265 | 9/1986 | Japan | 271/209 |
| 1235657 | 9/1989 | Japan . | |
| 143865 | 6/1991 | Japan . | |
| 100226 | 4/1994 | Japan | 271/209 |

OTHER PUBLICATIONS

Patent Abstracts of Japan, vol. 15, No. 362 (M–1157), 12 Sep. 1991.

*Primary Examiner*—Ren Yan

*Attorney, Agent, or Firm*—Fitzpatrick, Cella, Harper & Scinto

[57] ABSTRACT

An image forming apparatus in which an imaged sheet is discharged onto a stacking portion, includes a recording device for forming an image on a sheet, a discharge device for discharging a sheet on which the image was formed onto the stacking portion, a support means disposed downstream of the discharge device in a sheet discharging direction along a width-wise direction of the sheet to be discharged to support one surface of the sheet, and a shift device for shifting the support device between a support position to support the sheet to be discharged above the stacking portion and a retard position so as not to support the sheet.

34 Claims, 17 Drawing Sheets

IMAGE FORMING APPARATUS

BACKGROUND OF THE INVENTION

1. Field of the Invention

The present invention relates to an image forming apparatus such as a printer and the like, and more particularly, it relates to an image forming apparatus in which a sheet on which an image is formed is discharged onto a tray.

2. Related Background Art

In many image forming apparatuses, a sheet on which an image is recorded by a recording means is generally discharged onto a discharge tray. Such a discharge tray has also been used widely in ink jet image forming apparatuses which have recently been progressed. In such ink jet image forming apparatuses, since the recording is effected by discharging ink droplets onto a sheet, there is no problem when the normal recording (for example, having recording density for standard sentences and graphs) is effected. However, in case of high recording density such as recording density in color recording, an adequate ink fixing time period is required. In such ink jet image forming apparatuses, if an image forming speed is increased, a next sheet will be discharged before the ink is fixed to the previously discharged sheet, with the result that a tip end or a rear surface of the next sheet is contacted with the previous sheet, thereby distorting the image on the previous sheet.

To avoid such inconvenience, as disclosed in the Japanese Patent Laid-Open Application No. 1-235657, there has been proposed a method for promoting the drying of ink by using an infrared heater. When such a heater is used, the arrangement becomes complicated and the apparatus itself becomes more expensive. To avoid this, methods using no heater have been proposed.

For example, as shown in FIG. 21, a pair of opposed side rail members 50*a*, 50*b* are supported for pivotal movements around their pivot points 51*a*, 51*b*. Further, vertical walls 52*a*, 52*b* are provided with recesses 53*a*, 53*b* into which the side rail members 50*a*, 50*b* can be housed when the side rail members are rocked in directions indicated by arrows X. In this arrangement, a sheet S on which an image was formed is conveyed by a convey means (not shown) in a direction perpendicular to the plane of FIG. 21. In this condition, as shown in FIG. 21, the side rail members 50*a*, 50*b* are held in a closed position where the sheet S is supported by the side rail members to maintain the sheet S above a discharge portion 54*a* of a discharge tray 54.

When the sheet S is discharged, the side rail members 50*a*, 50*b* are rotated toward the directions indicated by arrows X to an open position where the sheet is not obstructed by the side rail members, thereby permitting the discharge of the sheet S onto the discharge portion 54*a*. In this way, the ink image recorded on the preceding sheet S discharged on the discharge portion 54*a* can be dried during the recording of the succeeding sheet, thereby preventing the contamination of the imaged surfaces of the sheets (refer to U.S. Pat. No. 4,794,859).

In another example wherein the heater is not used, there is provided a movable support arm for permitting the discharge of a sheet after the sheet reaches a terminal position of a convey path, and, while the sheet is being moved along the convey path, the arm is selectively positioned to contact with a central portion of a back surface of the sheet. As a result, during the recording, the succeeding sheet is maintained above a discharge tray portion and the ink image recorded on the preceding sheet discharged on the discharge tray can be dried, thereby preventing the contamination of the imaged surfaces of the sheets (refer to U.S. Pat. No. 4,844,633).

However, the above-mentioned conventional techniques line the following problems. In the former conventional technique, depending upon various sheet sizes, the side rail members 50*a*, 50*b* must be shifted in the sheet width-wise direction to meet with the selected sheet size. This requires a complicated mechanism. Further, when a large size sheet such as an A4 size (294 mm×420 mm) is used, the side rail members 50*a*, 50*b* must be enlarged in a sheet discharging direction, thereby making the apparatus bulky.

On the other hand, in the latter conventional technique, although the problems rising in the former conventional technique can be solved, the operation of the movable support arm must be synchronous with the sheet conveying operation. This requires a complicated mechanism.

SUMMARY OF THE INVENTION

The present invention intends to eliminate the above-mentioned conventional drawbacks, and has an object to provide an image forming apparatus which can prevent ink contamination of a sheet and distortion of an image formed on the sheet with a simple construction and without making the apparatus bulky, even when various sheets having different sizes are used.

To achieve the above object, according to the present invention, there is provided an image forming apparatus wherein an imaged sheet is discharged onto a stacking portion, comprising a recording means for forming an image on a sheet, a discharge means for discharging a sheet on which the image was formed onto a stacking portion, a support means disposed downstream of the discharge means along a width-wise of the sheet to be discharged to support one surface of the sheet, and a shift means for shifting the support means between a support position where the sheet to be discharged is supported above the stacking portion and a retard position where the sheet is not supported.

Since the support means is disposed along the width-wise direction of the sheet, regardless of the sheet size, any sheet can be supported without making the apparatus bulky. As a result, the sheet being charged is prevented from rubbing the imaged surface of the sheet already discharged to the stacking portion, thereby preventing the ink contamination and distortion of the image.

Further, by rotatingly shifting the support means between the support position and the retard position, the support and release of the sheet can be performed with a simple construction.

In addition, by supporting the sheet in a curved condition by means of the support means, since resiliency of the sheet is increased, a length of the support means can be reduced and the construction can be simplified.

DETAILED DESCRIPTION OF THE PREFERRED EMBODIMENTS

Figure 1:
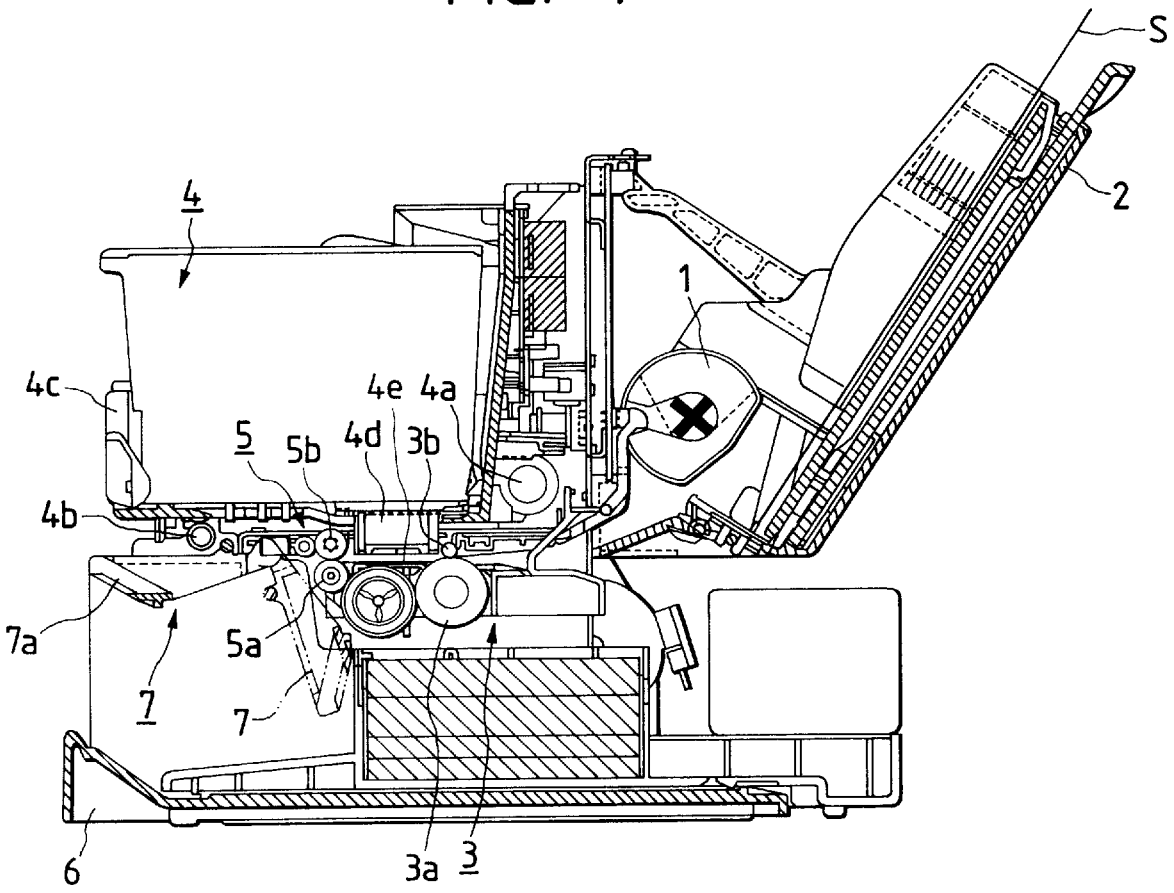
FIG. 1 is a sectional view of an image forming apparatus according to the first embodiment of the present invention.

The present invention will now be explained in connection with embodiments thereof with reference to the accompanying drawings.

[First Embodiment]

First of all, a first embodiment of the present invention will be described with reference to FIGS. 1 to 8.

{Entire Construction of Image Forming Apparatus}

Explaining the entire construction of the image forming apparatus firstly, a sheet supply roller 1 rotatingly driven by a motor (not shown) cooperates with a separation pawl (not shown) to separate sheets S supported on a supply tray 2 one by one from an uppermost one. The supplied sheet S is conveyed to a recording position by means of a drive convey roller 3*a* and a driven roller 3*b* for urging the sheet S against the drive convey roller. These rollers 3*a*, 3*b* constitute a convey means 3.

A recording means 4 serves to record an ink image on the sheet S conveyed by the convey means in an ink jet recording manner. Thus, in the illustrated embodiment, the recording means 4 is of an ink jet recording type. A recording head 4*a* is mounted on a carriage 4*c* reciprocally shiftable along a guide shaft 4*a* extending in a sheet widthwise direction and a guide rail 4*b*. While the recording head 4*d* is being driven in synchronism with the reciprocal movement of the carriage 4*c*, by discharging ink droplet toward the sheet S (a back surface of which is supported by a platen 4*e*) in response to an image signal, the ink image is formed on the sheet.

The recording head 4*d* includes fine or small liquid discharge openings (orifices), liquid passages communicated with the respective discharge openings, energy acting portions disposed in the respective liquid passages, and energy generating means for generating liquid droplet forming energy in the liquid at the acting portions. The energy generating means may be used as a recording method utilizing electrical/mechanical converters such as piezoelectrical elements, a recording method utilizing energy generating means for generating heat by illuminating an electromagnetic wave such as a laser and for discharging liquid droplets by action of the heat, or a recording method utilizing energy generating means for discharging liquid by heating the liquid by means of electrical/thermal converters such as heating elements having a heating resistance body.

Among these recording methods, in recording heads used in an ink jet recording method for discharging ink by thermal energy, since liquid discharge openings (orifices) for discharging recording ink droplets can be arranged with high density, the a recording having high resolving power can be expected. Among these recording heads, recording heads having electrical/thermal converters used as the energy generating means can easily be made compact, can be mounted with high density, and can be made cheaper.

Incidentally, in the illustrated embodiment, the recording head is designed so that the electrical/thermal converter is energized in response to a recording signal and the ink is discharged from the discharge opening by growth and contraction of a bubble generated in the ink by film-boiling caused by the thermal energy from the converter. Incidentally, the recording head 4*d* includes upper ink tanks for reserving inks, which ink tanks can be removably mounted on the carriage 4*c*.

A discharge means 5 includes a drive discharge roller 5*a* and driven spur wheels 5*b* urging the sheet against the discharge roller and serves to discharge the sheet S (on which the image was formed) onto a discharge tray (discharge portion) 6 with the imaged surface facing up. Incidentally, the spur wheel described herein means a rotary member having a small contact area (to the recording sheet S) so that, even when it is contacted with the imaged surface of the recording sheet, the ink image is not distorted.

When the image is formed on a rear part of the sheet S, since the sheet is supported only by the platen 4*e* opposed to the recording head 4*d*, a tip end of the sheet starts to be suspended. In this condition, as the discharge of the sheet continues, the suspended tip end of the sheet will rub the imaged surface (ink image) of the previous sheet already discharged on the discharge tray 6. To avoid this, in the illustrated embodiment, in order to prevent the tip end of the sheet discharged by the discharge means 5 from suspending downwardly, the sheet is supported by a support means 7 before the sheet is discharged onto the discharge tray 6.

{Construction of Support Means}

Figure 2:
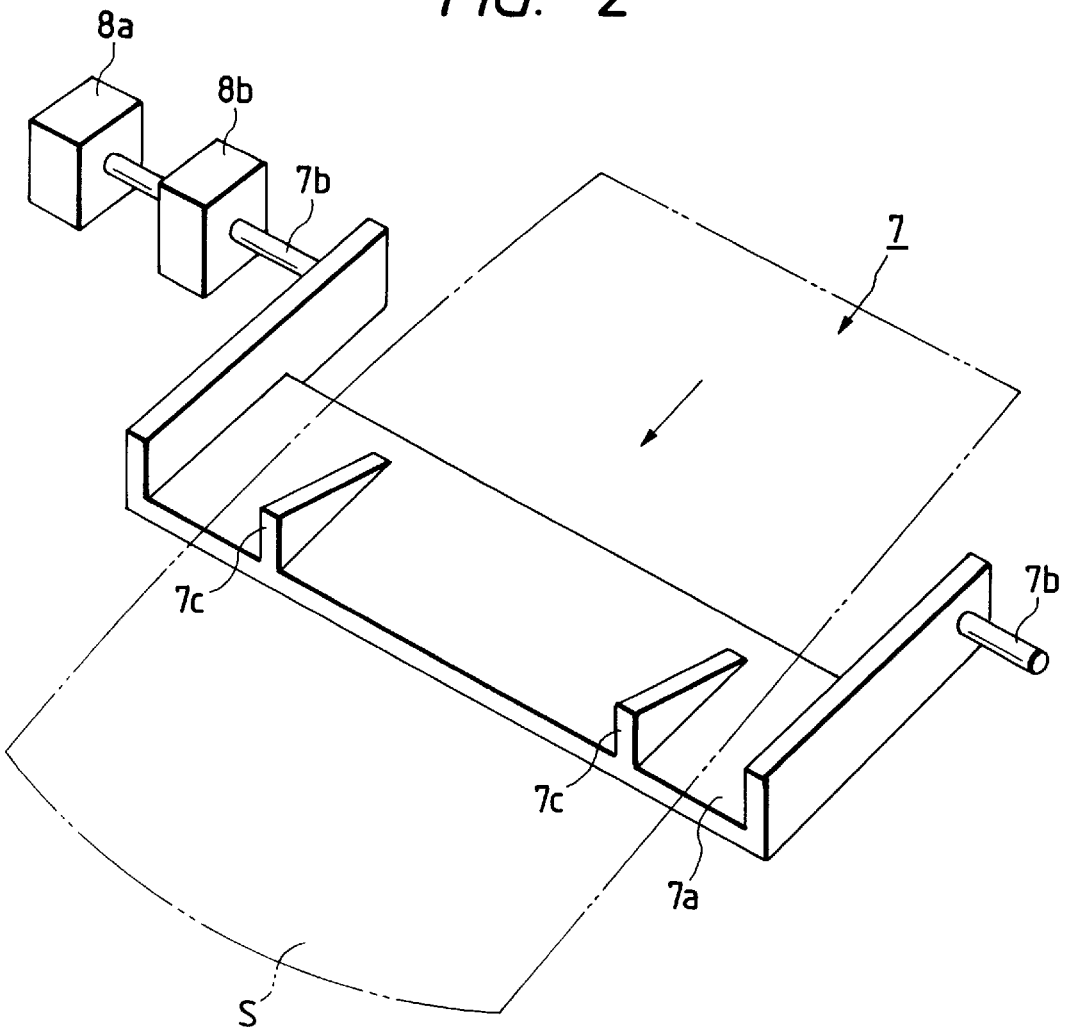
FIG. 2 is a perspective view of a support means according to the first embodiment.

Now, a construction of the support means 7 will be described. As shown in FIGS. 1 and 2, the support means 7 includes a plate-shaped support member 7*a* disposed above the discharge tray 6 and downstream of the discharge means 5 in a sheet conveying direction along an entire width of the sheet to support a non-imaged surface of the sheet S. As shown in FIG. 2, the support member 7*a* can be rocked around a shaft 7*b* perpendicular to the sheet discharging direction. The support member is rocked by a driving force transmitted from a shift means (motor 8*a* and driving force transmitting unit 8*b*) between a support position shown by the solid line in FIG. 1 and a retard position shown by the two-dot and chain line.

As will be described later, when the support member is in the support position, the back surface of the sheet discharged from the discharge means 5 is supported by the support member. On the other hand, when the support member is in the retard position, the sheet is not supported by the support member. As apparent from FIG. 1, the support member 7*a* is shifted within a discharge tray space formed in the apparatus. Accordingly, since the support member does not provide an obstacle even at the support position, either the support position or the retard position can be selected as a home position. A length of the support member 7*a* is considerably shorter than a length of the tray 6 (extended condition).

Figure 3:
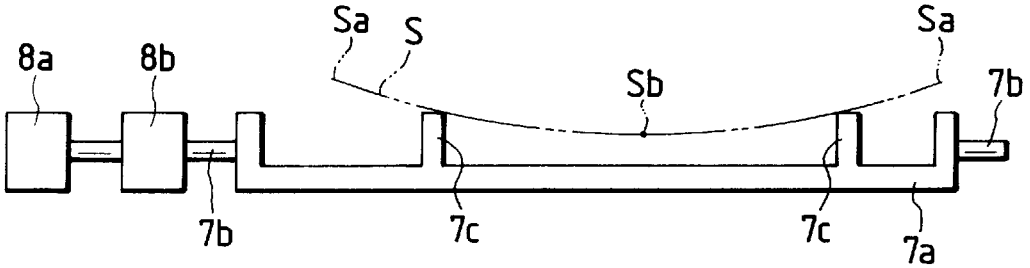
FIG. 3 is a view of the support means according to the first embodiment, looked at from a sheet discharging direction.

As shown in FIG. 2, a sheet support surface of the support member 7*a* is provided with two support ribs 7*c* spaced apart from each other by a predetermined distance. The ribs 7*c* are gradually protruded (inclined) from the sheet support surface of the support member 7*a* toward the sheet discharging direction. In the condition that the support member 7*a* is in the support position, when the sheet S is fed to the support member, the sheet S is discharged while riding over the ribs 7*c*. In this case, the sheet S is supported by the ribs 7*c* so that, as shown in FIG. 3 (schematic view looked at from the sheet discharging direction), a central portion Sb of the sheet becomes concave downwardly in comparison with both width-wise end portions Sa of the sheet. As a result, the rigidity of the sheet S is increased, thereby preventing the tip end of the sheet from suspending.

Figure 4:
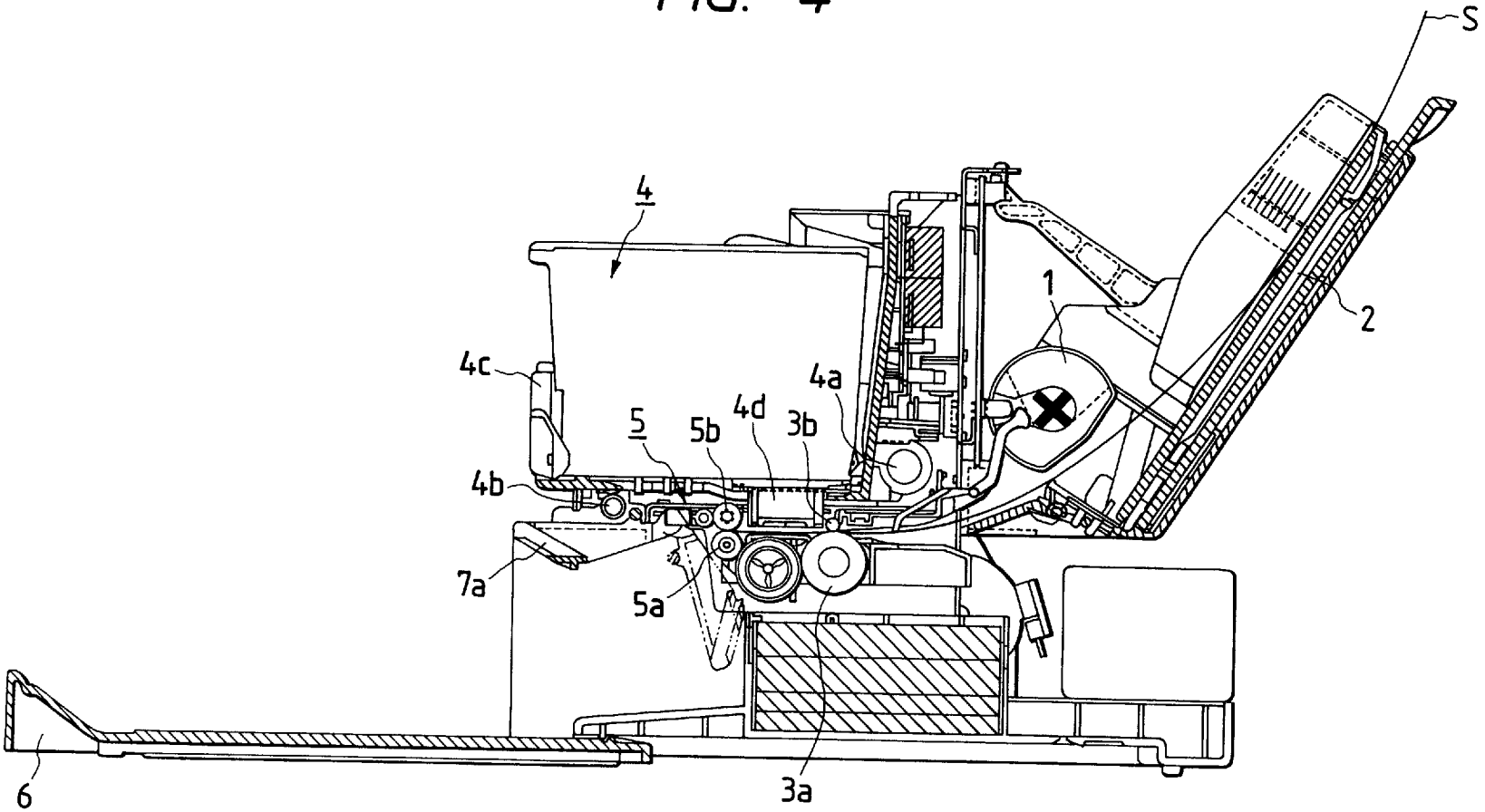
FIG. 4 is a sectional view of the image forming apparatus according to the first embodiment, showing a condition that the recording on a sheet is started.
Figure 5:
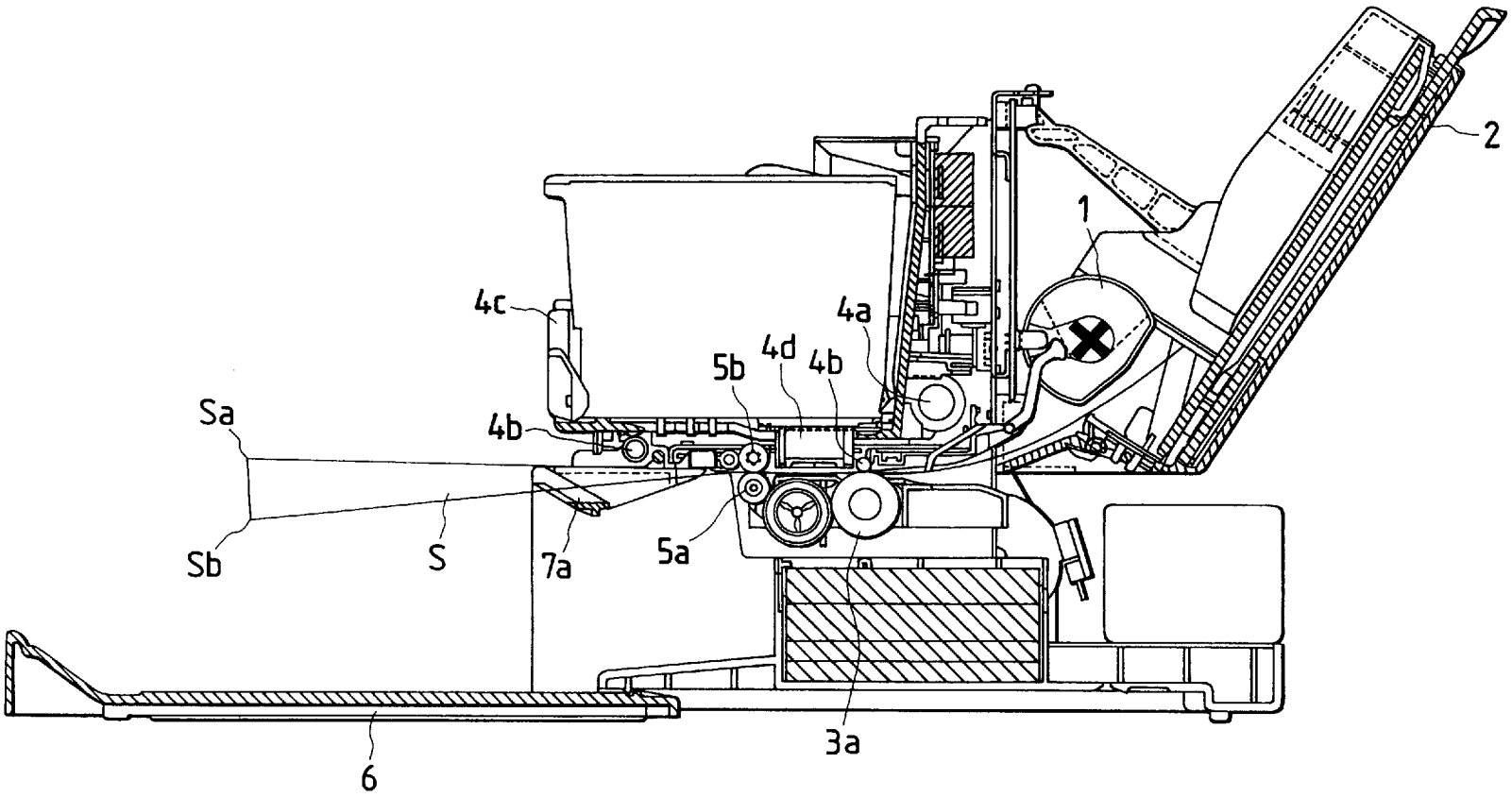
FIG. 5 is a sectional view of the image forming apparatus according to the first embodiment, showing an initial condition that the sheet is discharged.
Figure 6:
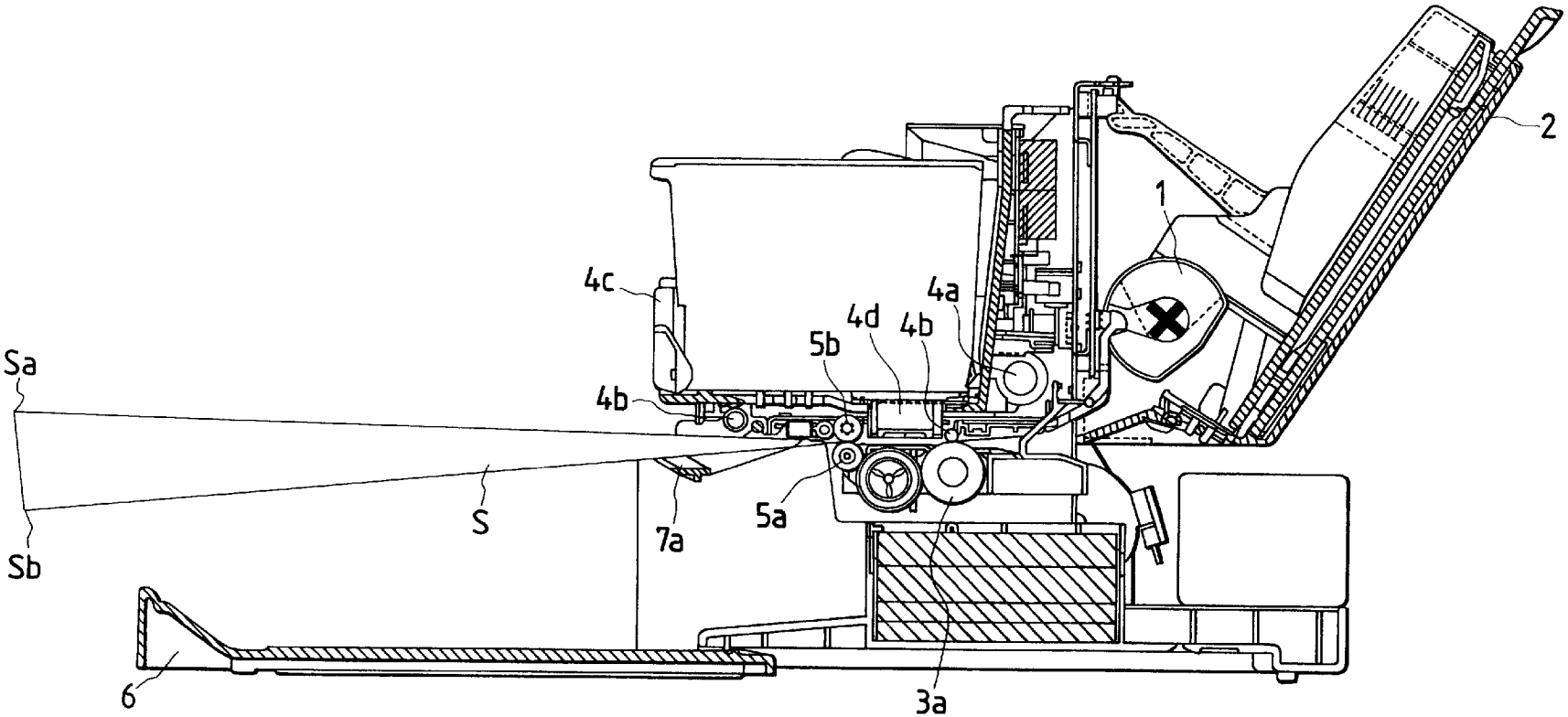
FIG. 6 is a sectional view of the image forming apparatus according to the first embodiment, showing a condition that the sheet is further discharged.

Next, an operation of the support means 7 when the sheet S is discharged will be explained. As shown in FIG. 4, in the condition that the support member 7*a* is in the support position, when the recording is started, the sheet S on which the image is recorded by the recording means 4 is gradually discharged out of the apparatus by the discharge means 5, and, as shown in FIG. 5, the back surface (non-imaged surface) of the sheet S is supported by the support member 7*a*. In this case, as mentioned above, since the sheet gradually rides over the ribs 7*c*, the sheet is curved in a concave shape along the sheet width-wise direction so that the width-wise central portion Sb of the sheet is positioned below the width-wise both end portions Sa of the sheet, as seen from FIGS. 5 and 6 (sectional views). Thus, as mentioned above, the rigidity of the sheet S is increased, so that, as shown in FIG. 6, even after the recording of the sheet S is finished, the sheet is supported by the support member 7*a* without suspending the tip end of the sheet.

Figure 7:
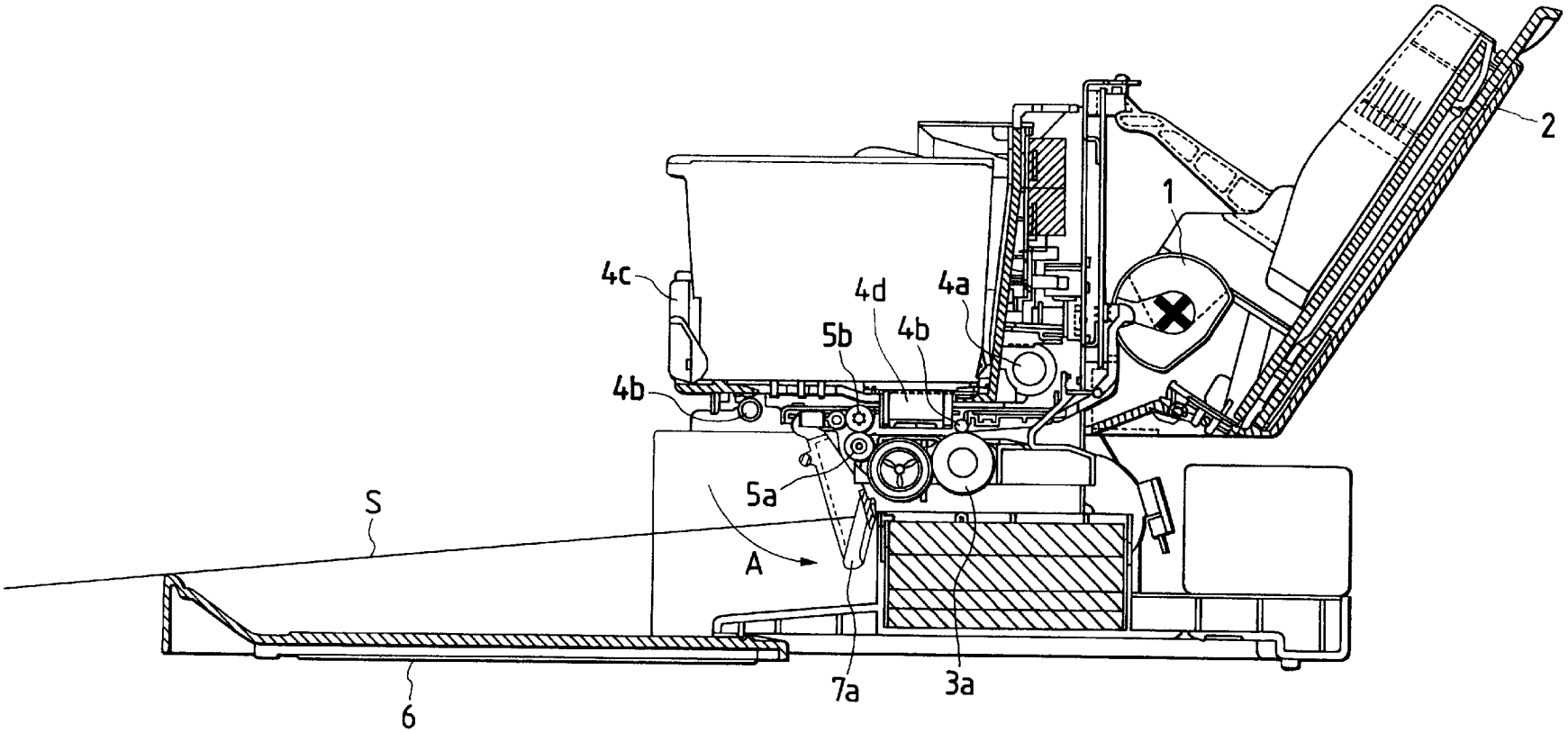
FIG. 7 is a sectional view of the image forming apparatus according to the first embodiment, showing a condition that the sheet is discharged onto a discharge tray.
Figure 8:
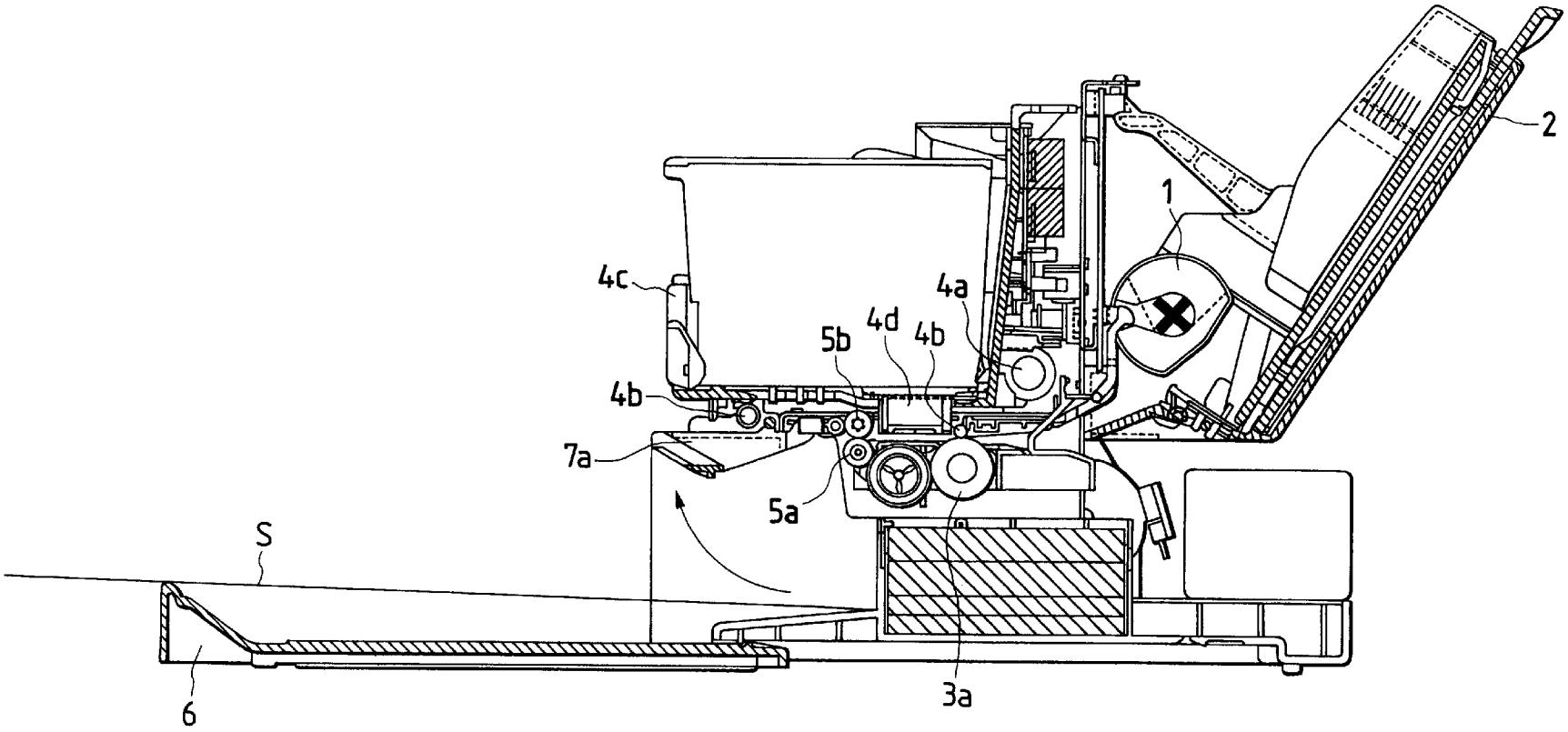
FIG. 8 is a sectional view of the image forming apparatus according to the first embodiment, showing a condition that the support means is returned to a waiting position after the sheet was discharged on the discharge tray.

When the discharging operation of the discharge means 5 is finished, a trail end of the sheet is detected by a sensor disposed in the discharge portion. When a predetermined time period is elapsed after the detection of the trail end of the sheet, as shown in FIG. 7, by driving the motor 8*a*, the support member 7*a* is rotated in a direction shown by the arrow A to shift the support member to the retard position. As a result, since the back surface of the sheet is not supported, the sheet is dropped onto the discharge tray 6 (extended in accordance with the sheet size). That is to say, the tip end portion of the sheet firstly rides on a protruded portion of the discharge tray, and then the trail end of the sheet drops on the tray. In the illustrated embodiment (FIG. 7), although the sheet is slightly slid forwardly, when the support member 7*a* is further rotated in the anti-clockwise direction, the sliding movement of the sheet is stopped. Thereafter, as shown in FIG. 8, the support member 7*a* is rotated to the support position to achieve a waiting condition for preparation for next discharge. Incidentally, as shown in FIG. 7, the length of the support member 7*a* is selected to be smaller than a height between the tray 6 and the discharge portion.

In this way, with a simple construction in which the support member 7*a* having the ribs 7*c* is merely rotated, the sheet can be supported until the recording of the sheet is finished. Thus, since the tip end of the sheet can be prevented from rubbing the imaged surface of the previous sheet already discharged on the tray 6, the ink image on the previous sheet is not distorted and the ink contamination does not occur. Further, since the support member 7*a* is positioned along the entire width of the sheet, regardless of the sheets width size, both large sheets and small sheets can be supported by the support member without making the apparatus bulky.

Incidentally, in the illustrated embodiment, while an example that the ribs 7*c* are integrally formed with the support member 7*a* was explained, ribs may be formed from small wedge members independently from the support member, and the wedge members may be pivotally mounted on the support member and may be biased by elastic members such as springs for movement in an up-and-down direction so that the action of the ribs can be reduced when a hard sheet is discharged.

[Second Embodiment]

Next, as a second embodiment of the present invention, another example of a support means will be explained with reference to FIG. 9. Incidentally, since elements other than the support means are the same as those in the first embodiment, an explanation thereof will be omitted. Further, elements having the same function as that of the first embodiment are designated by the same reference numerals and explanation thereof will be omitted. This is true regarding other embodiments which will be described later.

Figure 9:
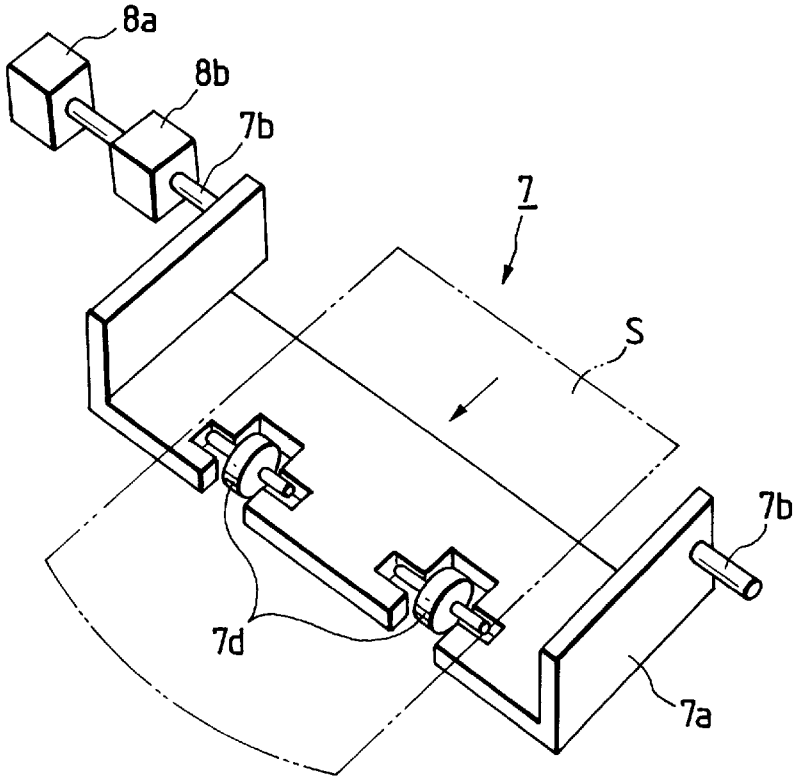
FIG. 9 is a perspective view of a support means according to the second embodiment of the present invention.

In a support means 7 shown in FIG. 9, in place of the ribs 7*c* provided on the support member 7*a* of the first embodiment, two rotatable support rollers 7*d* are provided.

When the sheet S is discharged onto the support member 7*a*, the non-imaged surface of the sheet is supported by the support rollers 7*d*. In this condition, when the sheet is further advanced, the rollers 7*d* are rotated in accordance with the movement of the sheet S. With this arrangement, since rolling contact is created between the support rollers 7*d* and the sheet S, sliding resistance is decreased to advance the sheet more smoothly.

[Third Embodiment]

Next, as a third embodiment of the present invention, a further example of a support means will be explained with reference to FIG. 10.

Figure 10:
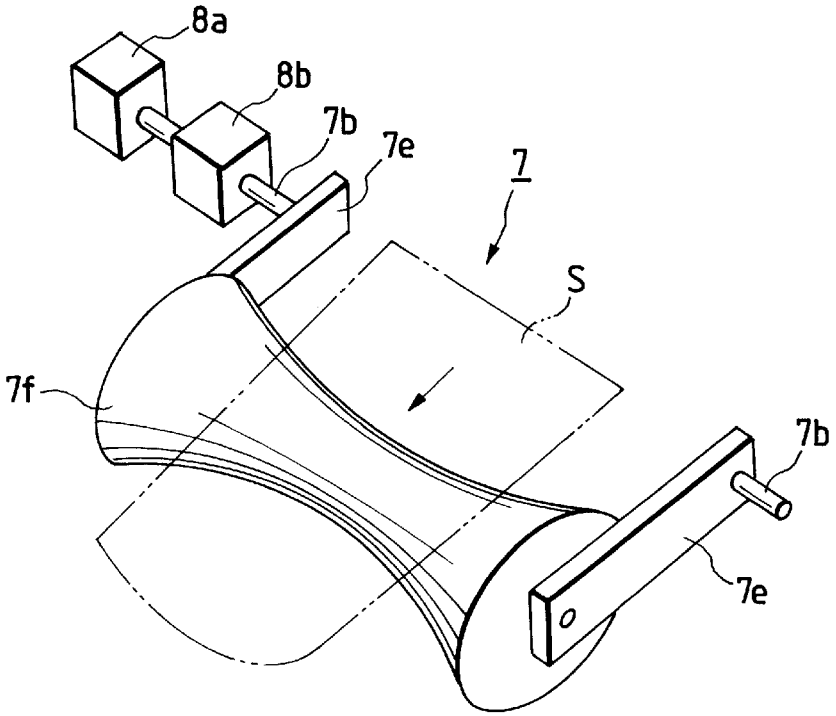
FIG. 10 is a perspective view of a support means according to the third embodiment of the present invention.

In a support means 7 shown in FIG. 10, in place of the support member 7*a* and the ribs 7*c* of the first embodiment, there are provided support arms 7*e* supported for pivotal movement and a hand-drum shaped rotary member 7*f* rotatably mounted on free ends of the support arms and capable of supporting the entire width of the sheet.

In this support means, when the sheet S is discharged, the non-imaged surface of the sheet is supported by the rotary member 7*f* and the sheet S is curved in a concave shape by the hand-drum configuration of the rotary member 7*f*. In this condition, as the sheet is advanced, the rotary member 7*f* continues to support the sheet while rotating. Consequently, as is in the second embodiment, the sliding resistance to the sheet S is decreased. Further, the entire construction of the support means can be more simplified.

[Fourth Embodiment]

Next, as a fourth embodiment of the present invention, a still further example of a support means will be explained with reference to FIG. 11.

Figure 11:
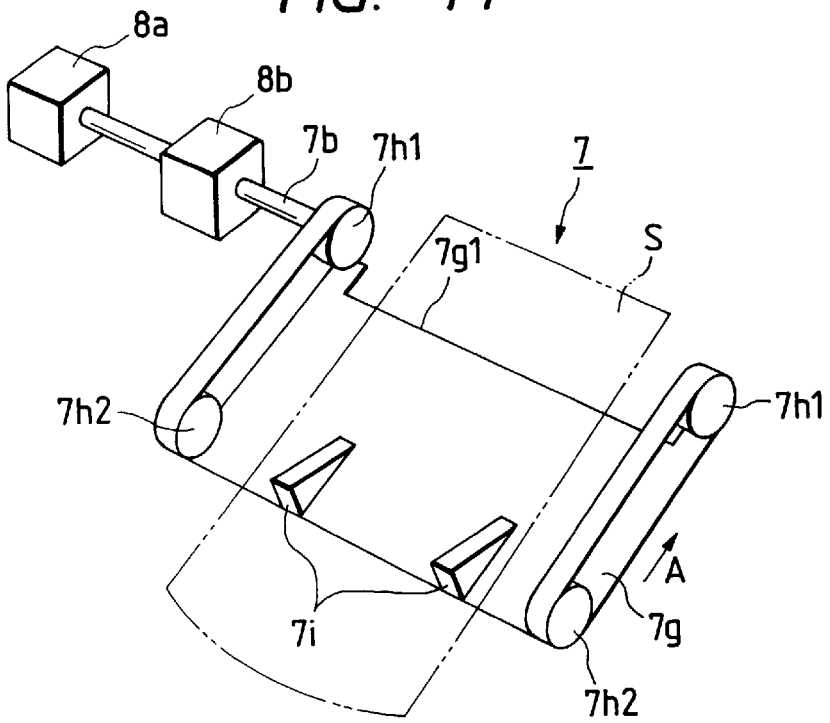
FIG. 11 is a perspective view of a support means according to the fourth embodiment of the present invention.

In a support means 7 shown in FIG. 11, in place of the support member 7*a* of the first embodiment, a rotatable support belt 7*g* is provided. The support belt 7*g* is an endless belt having a width greater than the width of the sheet and mounted around drive pulleys 7*h*1 rotated by the motor 8*a* and driven pulleys 7*h*2 disposed downstream of the drive pulleys 7*h*1 in the sheet discharging direction. And, a portion of the endless belt other than portions directly associated with the pulleys 7*h*1, 7*h*2 is cut away or removed by about a half of an entire peripheral length to provide a cut-out portion 7*g*1. Further, two ribs 7*i* (corresponding to the ribs 7*c* in the first embodiment) are provided on the remaining portion of the support belt 7*g* at predetermined positions.

With the arrangement as mentioned above, when the sheet S is discharged onto the support belt 7*g*, the non-imaged surface of the sheet is supported by the ribs 7*i* to curve the sheet in a concave shape. Then, after the recording, when the motor 8*a* is driven, the support belt 7*g* is rotated in a direction shown by the arrow A in FIG. 11. When the support belt 7*g* is rotated by about a half of the entire peripheral length, the cut-out portion 7*g*1 is opposed to the sheet not to support the sheet S, with the result that the sheet S is dropped onto the discharge tray 6. Thereafter, when the support belt 7*g* is further rotated in thin the direction A by the remaining peripheral length (one revolution in total) to return the belt to the initial position (waiting condition) where a next sheet can be supported by the ribs 7*i*.

By rotating the support belt 7*g*, the same advantage as that obtained by the support means of the first embodiment can be expected.

[Fifth Embodiment]

Figure 12:
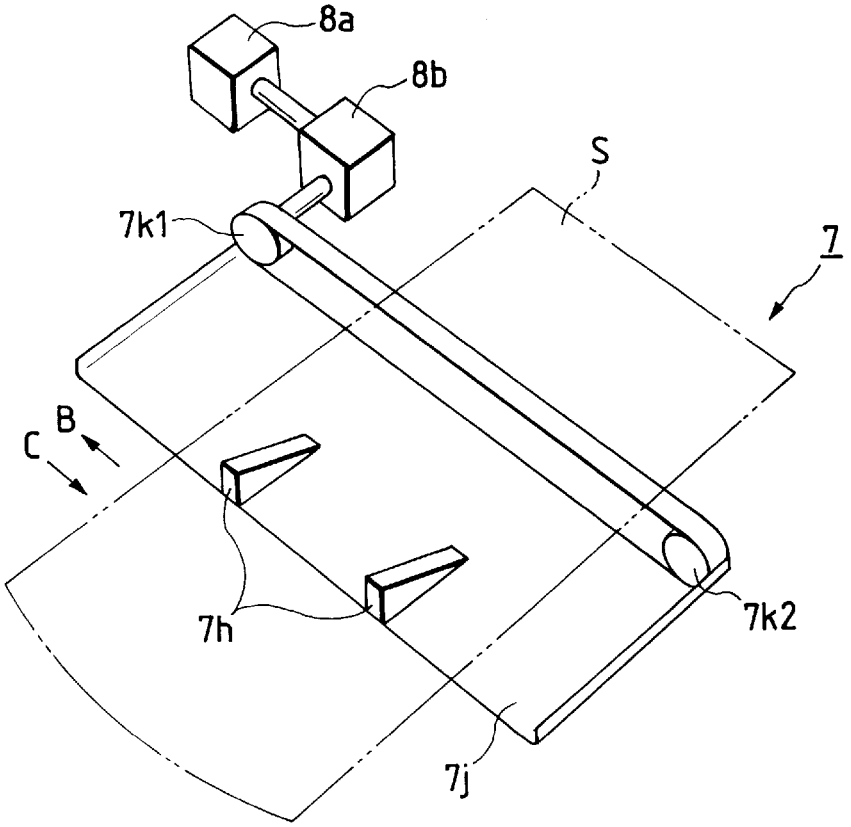
FIG. 12 is a perspective view of a support means according to the fifth embodiment of the present invention.

Next, as a fifth embodiment of the present invention, a further example of a support means will be explained with reference to FIG. 12.

In a support means 7 shown in FIG. 11, a rotatable support belt 7*j* similar to that of the fourth embodiment is used, but a rotational direction of the support belt differs from that of the support belt in the fourth embodiment by 90 degrees. More concretely, the support belt is an endless belt mounted around a drive pulley 7*k*1 rotated by the motor 8*a* and a driven pulley 7*k*2 spaced apart from the pulley 7*k*1 by a distance greater than the width of the sheet. And, a portion of the endless belt other than a portion directly associated with the pulleys 7*k*1, 7*k*2 is cut away or removed by about a half of an entire peripheral length to provide a cut-out portion. Further, two ribs 7*n* are provided on the remaining portion of the support belt 7*j* at predetermined positions.

With the arrangement as mentioned above, when the sheet S is discharged onto the support belt 7*j*, the non-imaged surface of the sheet is supported by the ribs 7*n* to curve the sheet in a concave shape. Then, after the recording, when the motor 8*a* is driven, the support belt 7*j* is rotated in a direction shown by the arrow B or C in FIG. 12. When the support belt 7*j* is rotated by about a half of the entire peripheral length, the sheet S is not supported by the support belt, with the result that the sheet S is dropped onto the discharge tray 6. Thereafter, when the support belt 7*j* is further rotated by the remaining peripheral length (one revolution in total) to return the belt to the initial position (waiting condition) where a next sheet can be supported by the ribs 7*n*.

In this fifth embodiment, the same advantage as that obtained in the fourth embodiment can be expected, and the stop position of the belt 7*j* can be adjusted to change the position of the ribs 7*n* for supporting the sheet S, thereby permitting fine adjustment for various sheets having different size.

Incidentally, the belts 7*j*, 7*g* used in the fifth and fourth embodiments may be formed from elastic material such as rubber, material including filaments therein or thin material having no rigidity. Further, the number of the pulleys is not limited to one pair or two pairs.

[Sixth Embodiment]

Next, as a sixth embodiment of the present invention, a still further example of a support means will be explained with reference to FIGS. 13 to 18.

Figure 13:
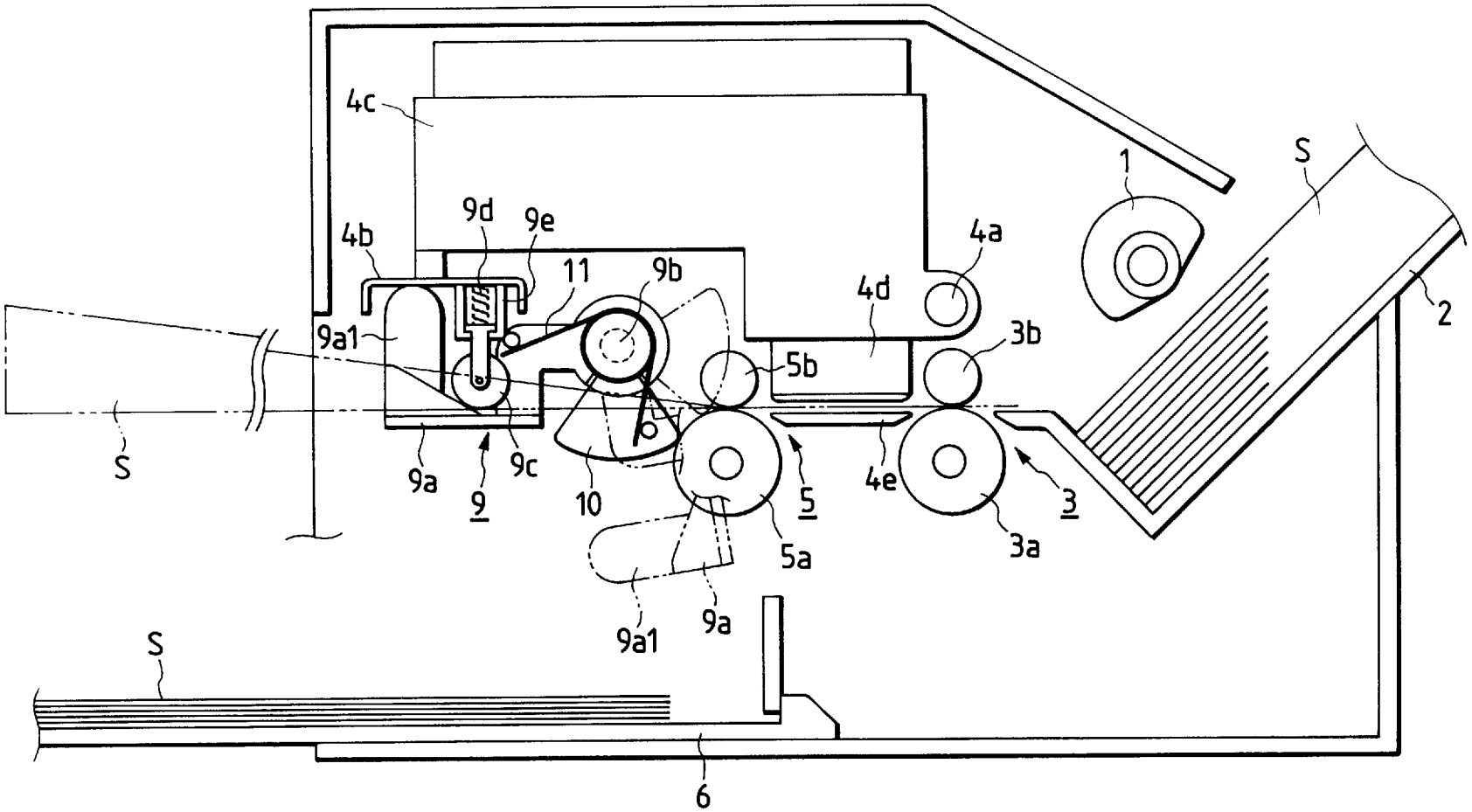
FIG. 13 is a sectional view of an image forming apparatus according to the sixth embodiment of the present invention.
Figure 14:
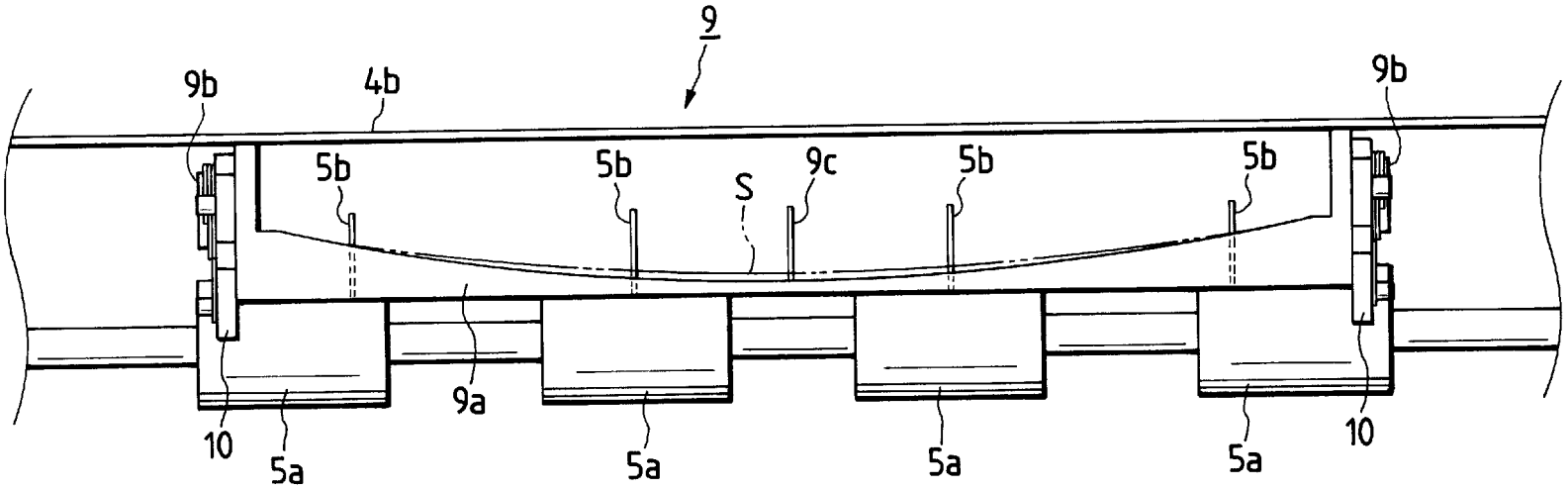
FIG. 14 is a view of the support means according to the sixth embodiment, looked at from a sheet discharging direction.

In a support means 9 according to the sixth embodiment, as shown in FIG. 14 (view looked at from the sheet discharging direction), a support member 9*a* for supporting the non-imaged surface of the sheet S through the entire width thereof is disposed above the discharge tray 6 at a downstream side of the discharge means 5 in the sheet conveying direction. The support member 9*a* can be rocked around shafts 9*b* perpendicular to the sheet discharging direction. The support member is rocked by a shift means (described later) between a support position shown by the solid line in FIG. 13 and a retard position shown by the two-dot and chain line. When the support member is in the support position, the back surface of the sheet discharged from the discharge means 5 is supported by the support member. On the other hand, when the support member is in the retard position, the sheet is not supported by the support member. This is the same as the first embodiment.

As shown in FIG. 14, a sheet support surface of the support member 9*a* is curved in a concave shape along the width-wise direction of the sheet. A rotary member 9*c* acting as a biasing means (spur wheel in the illustrated embodiment) is rotatably supported above the support member 9*a* at a central position of the width of the sheet. As shown in FIG. 13, the spur wheel 9*c* is supported on a holder 9*e* to be biased downwardly by a spring 9*d*, thereby biasing the imaged surface of the discharged sheet S substantially downwardly in a vertical direction (toward the support member 9*a*). Due to such a biasing action, as shown by the two-dot and chain line in FIG. 14, the sheet S discharged while being supported by the support means 9 is curved in a concave shape along the curved surface of the support member 9*a*. Incidentally, as shown in FIG. 13, the holder 9*c* is secured to a back surface of the guide rail 4*b*.

With this arrangement, as is in the aforementioned embodiments, the rigidity of the discharged sheet S is increased, with the result that the sheet S is advanced in the sheet discharging direction without suspending the tip end of the sheet downwardly. Thus, since the tip end of the sheet does not directly contact with the previous sheet S rested on the discharge tray 6 not to distort the ink image on the previous sheet.

As shown in FIG. 14, since the support member 9*a* has the continuous concave configuration along the width-wise direction of the sheet S, even when a sheet having a different size (for example, a sheet having a width smaller than that of the sheet S shown in FIG. 14) is used, as in the sheet S, a concave shape is formed in the sheet to increase the rigidity thereof. Accordingly, even when various sheets having different size are used, any sheet can be advanced without suspending a tip end of the sheet downwardly, thereby preventing the tip end of the sheet from rubbing the imaged surface of the previous sheet S to prevent distortion of the ink image on the previous sheet.

After the recording is finished, when the support member 9*a* is shifted to the position shown by the two-dot and chain line in FIG. 13, the non-imaged surface of the sheet is not supported, with the result that the sheet S is dropped onto the discharge tray 6 by its own weight. Thus, the sheet stacking ability is not worsened. As is in the first embodiment, the support member 9*a* is returned to a waiting position shown by the solid line in FIG. 13.

Also in this embodiment, with a simple construction in which the spur wheel 9*c* is provided and the support member 9*a* having the concave support surface is pivotally supported, as is in the first embodiment, the tip end of the sheet S can be prevented from rubbing the imaged surface of the previous sheet already discharged on the discharge tray 6 until the recording is finished. Thus, the ink image of the previous sheet discharged on the discharge tray 6 is not distorted and the ink contamination can be prevented.

Figure 15:
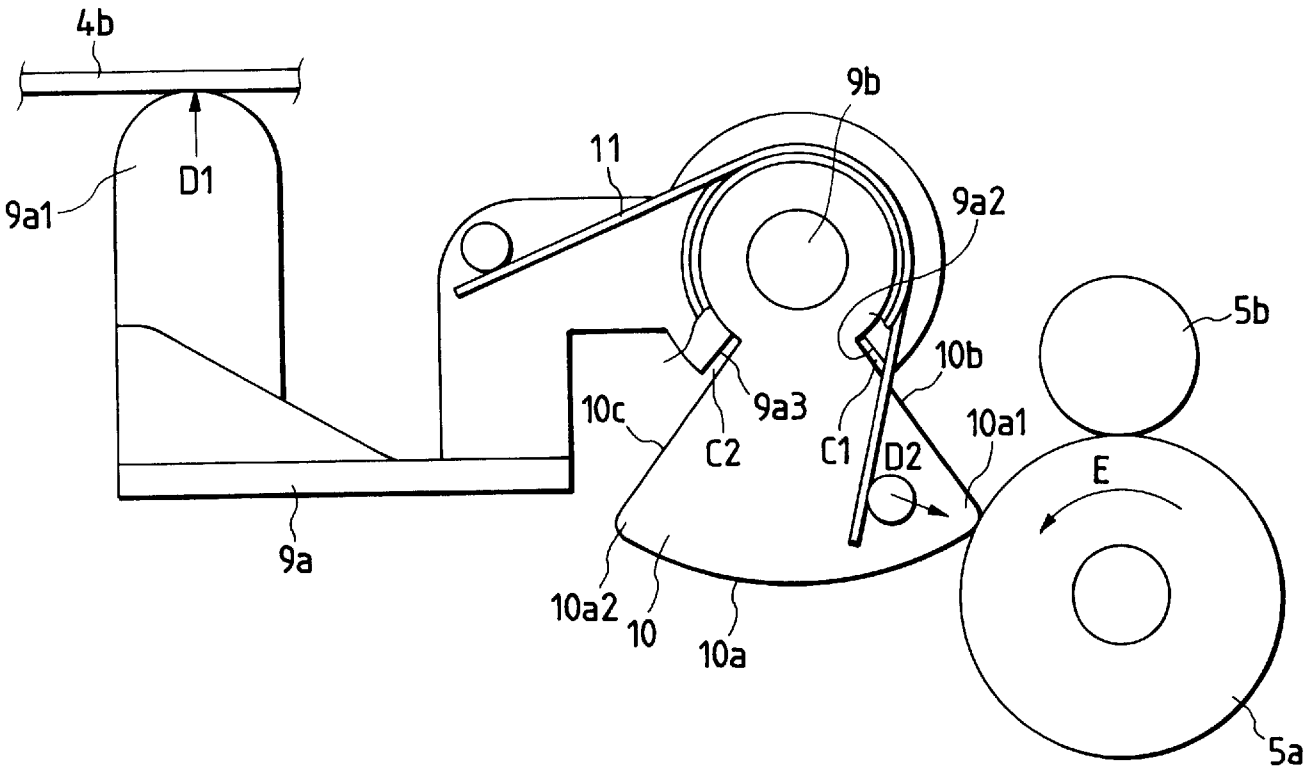
FIG. 15 is a view of the support means according to the sixth embodiment, showing a condition that a support member of the support means is in a sheet support position.

Next, the shift means for rocking the support member 9*a* will be explained. As shown in FIG. 15, the shift means includes driving force transmitting portions 10 each having a cam portion 10*a* having a pivot center coaxial with the shaft 9*b* for the support member 9*a* and capable of transmitting a driving force to the support member 9*a* to rock the support member between the support position and the retard position, and springs 11 disposed between the support member 9*a* and the driving force transmitting portions 10. Each cam portion 10*a* has a circular arc profile centered at the respective shaft 9*b*, and a radius of the cam profile is substantially equal to a distance between the shaft 9*b* and a peripheral surface of the corresponding discharge roller portion 5*a*.

FIG. 15 shows a sheet supporting condition. In this condition, the support member 9*a* is biased toward a direction D1 by the springs 11 via stopper portions 9*a*1 of the support member 9*a* to be abutted against the guide rail 4*b*. On the other hand, in each driving force transmitting portion 10, since one end 10*a*1 of the cam portion 10*a* is biased by the spring 11 toward a direction D2 in FIG. 15 to be abutted against the peripheral surface of the discharge roller portion 5*a*, the support member 9*a* is maintained in the sheet supporting condition. In the sheet supporting condition, although the discharge roller 5*a* is rotated in a direction shown by the arrow E during the recording, since only the weight of the support member 9*a* acts on the discharge roller 5*a* as an abutting force, the sheet supporting condition can be maintained.

Figure 16:
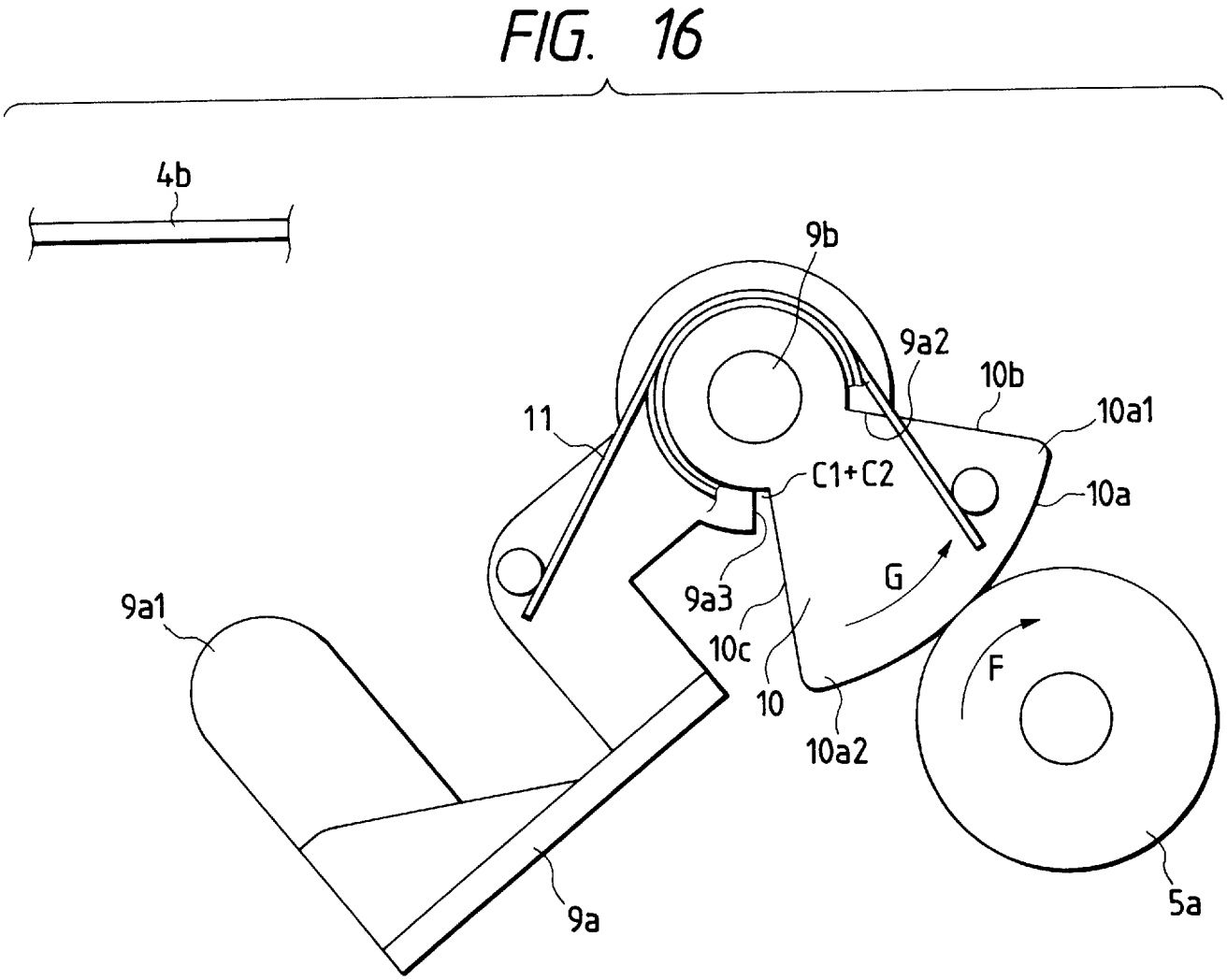
FIGS. 16 and 17 are views of the support means according to the sixth embodiment, showing a condition that the support member of the support means is shifted from the sheet support position to a retard position.

After the recording of the sheet is finished (as mentioned above, timing may be determined by the sensor), or, when a predetermined time period is elapsed after a record finish signal is emitted, the discharge roller 5*a* is rotated in a direction shown by the arrow F in FIG. 16 in order to retard the support member 9*a*. As a result, the driving force transmitting portion 10 is rotated in a direction shown by the arrow G until a gap C1 (refer to FIG. 15) formed between the support member 9*a* and the driving force transmitting portion 10 due to the abutment between one end 10*a*1 of the cam portion 10*a* and the discharge roller 5*a* is disappeared. At this point, since an abutment portion 10*b* of the driving force transmitting portion 10 is engaged by an abutment portion 9*a*2 of the support member 9*a*, the support member 9*a* starts to rotate in the direction G.

Figure 17:
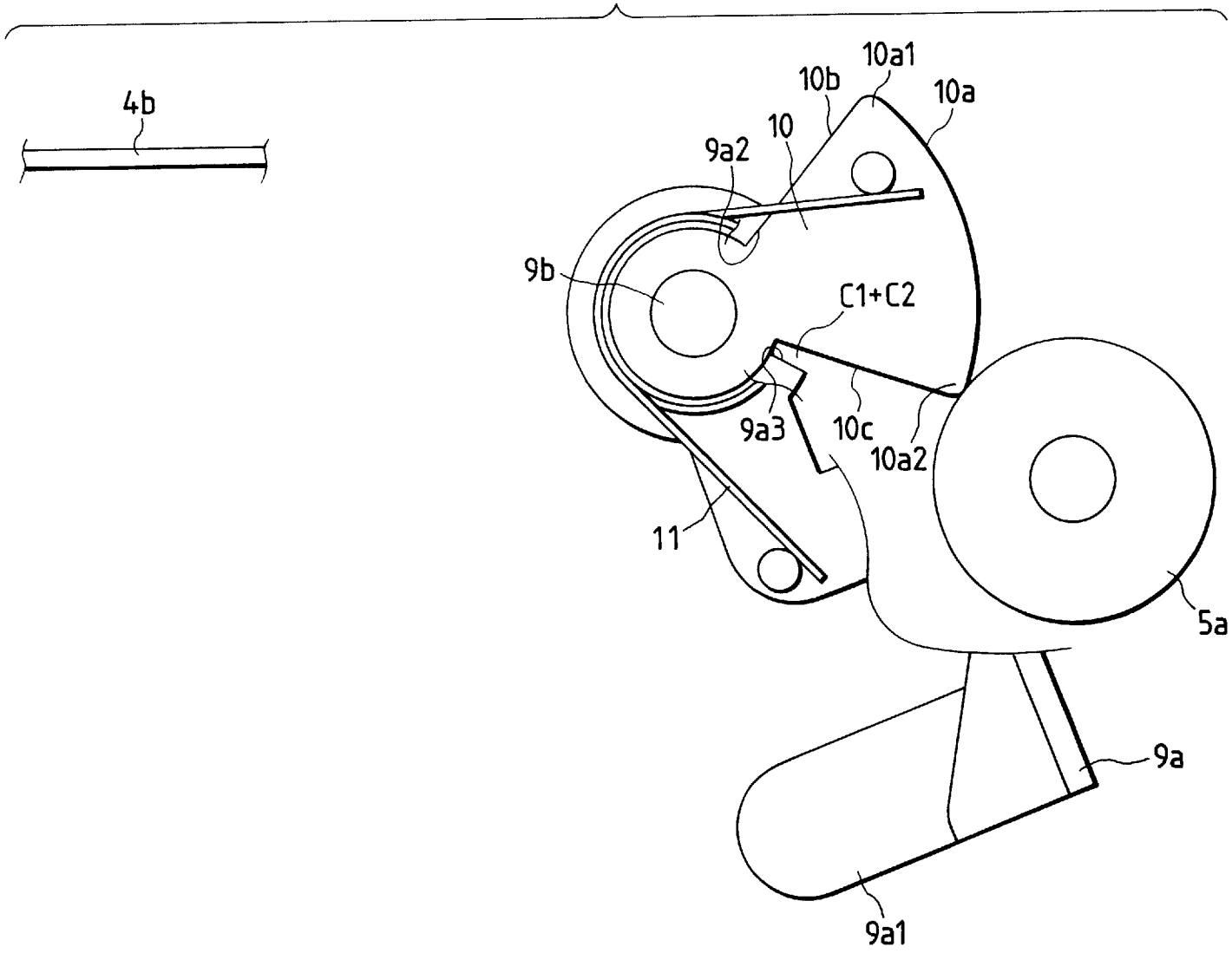
Figure 18:
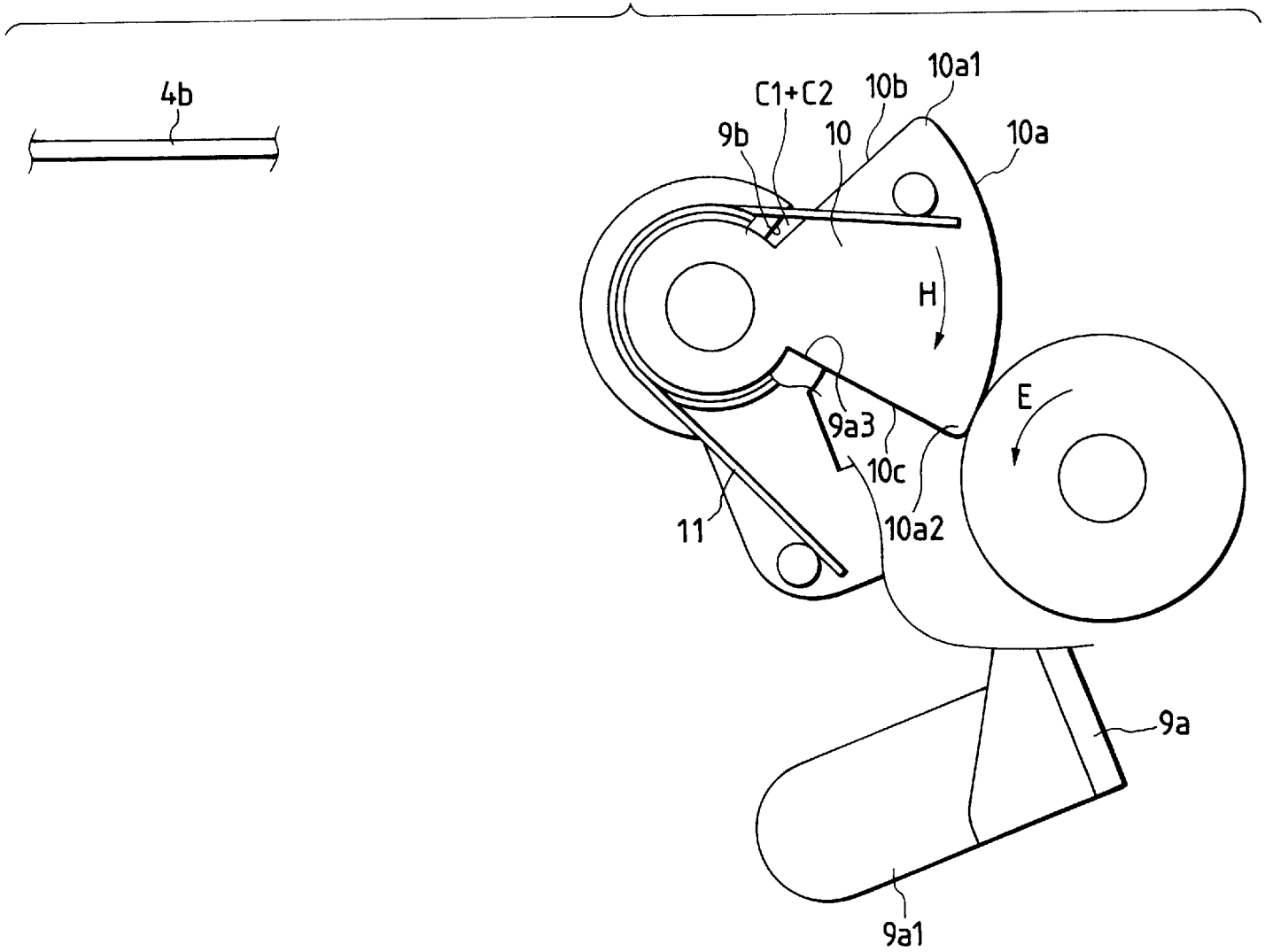
FIG. 18 is a view of the support means according to the sixth embodiment, showing a condition that the support member of the support means is shifted from the retard position to the sheet support position.

Thereafter, as shown in FIG. 17, the support member 9*a* is further rotated until the cam portion 10*a* of the driving force transmitting portion 10 leaves the discharge roller. Then, the other end 10*a*2 of the cam portion 10 abuts against the discharge roller 5*a* by the weight of the support member 9*a*, thereby maintaining the support member 9*a* in the retard position. When the recording is re-started, as shown in FIG. 18, the discharge roller 5*a* is rotated in the direction E. As a result, the driving force transmitting portion 10 is rotated in a direction shown by the arrow H until a gap (C1+C2) (refer to FIG. 17) formed between the support member 9*a* and the driving force transmitting portion 10 is disappeared. At this point, since an abutment portion 10*c* of the driving force transmitting portion 10 is engaged by an abutment portion 9*a*3 of the support member, the support member 9*a* starts to rotate in the direction H to be returned to the sheet supporting condition shown in FIG. 15.

In the illustrated embodiment, as mentioned above, the driving force transmitting portions 10 for shifting the support member 9*a* between the support position and the retard position are formed independently from the support member 9*a* and the springs 11 for biasing the driving force transmitting portions 10 away from the support member 9*a* are also provided. With this arrangement, the same advantage as those in the aforementioned embodiments can be expected, and any special drive source for shifting the support member 9*a* can be omitted. Further, it is possible to minimize the increase in the loading torque generated during the operation of the support member, thereby reducing the wear of the discharge roller 5*a* and obtaining a high reliable apparatus without increasing the manufacturing cost.

[Seventh Embodiment]

Next, as a seventh embodiment of the present invention, a further example of a support means will be explained with reference to FIG. 19 (view looked at from the sheet discharging direction).

Figure 19:
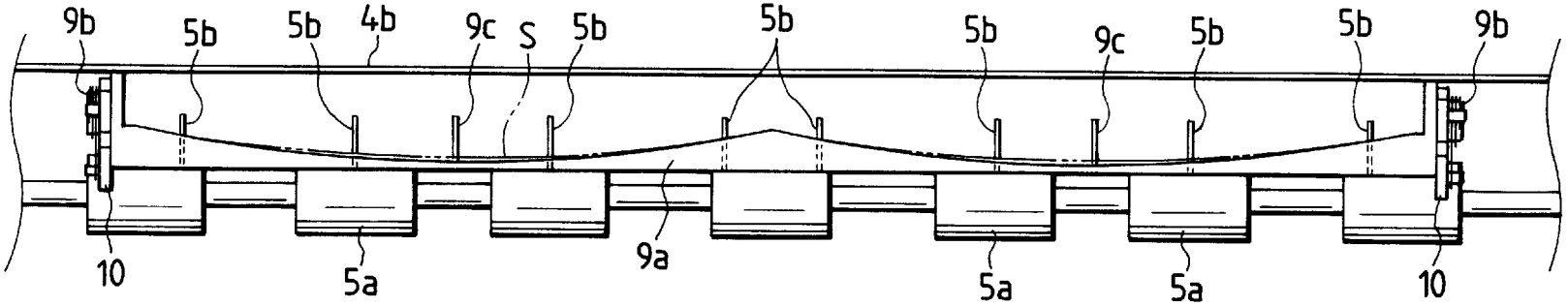
FIG. 19 is a view of a support means according to the seventh embodiment of the present invention, looked at from a sheet discharging direction.

In the support means according to this embodiment, as shown in FIG. 19, a support member 9*a* extends through the entire width of the sheet S, and a sheet support surface of the support member is curved to provide two concave portions disposed on both sides of the central position of the sheet width-wise direction. Further, biasing spur wheels 9*c* are positioned above the deepest points of the concave portions.

With this arrangement, as the sheet S is discharged, the sheet S supported by the support member 9*a* is curved to form two concave surfaces in the sheet. As a result, the rigidity of the sheet S is increased, thereby preventing the tip end of the sheet from suspending downwardly more effectively. The support means according to this embodiment is effective particularly when a large size sheet is used. That is to say, in order to provide the concave surface in the large size sheet to advance the sheet in the sheet discharging direction without contacting with the previous sheet already discharged on the discharge tray 6, a curved amount of the concave surface may be increased. However, in this case, the entire apparatus will become bulky. To the contrary, in the illustrated embodiment, since the curved amount can be minimized by increasing the number of the concave surfaces, the apparatus does not become bulky.

[Eighth Embodiment]

Next, as an eighth embodiment of the present invention, a still further example of a support means will be explained with reference to FIG. 20 (view looked at from the sheet discharging direction).

Figure 20:
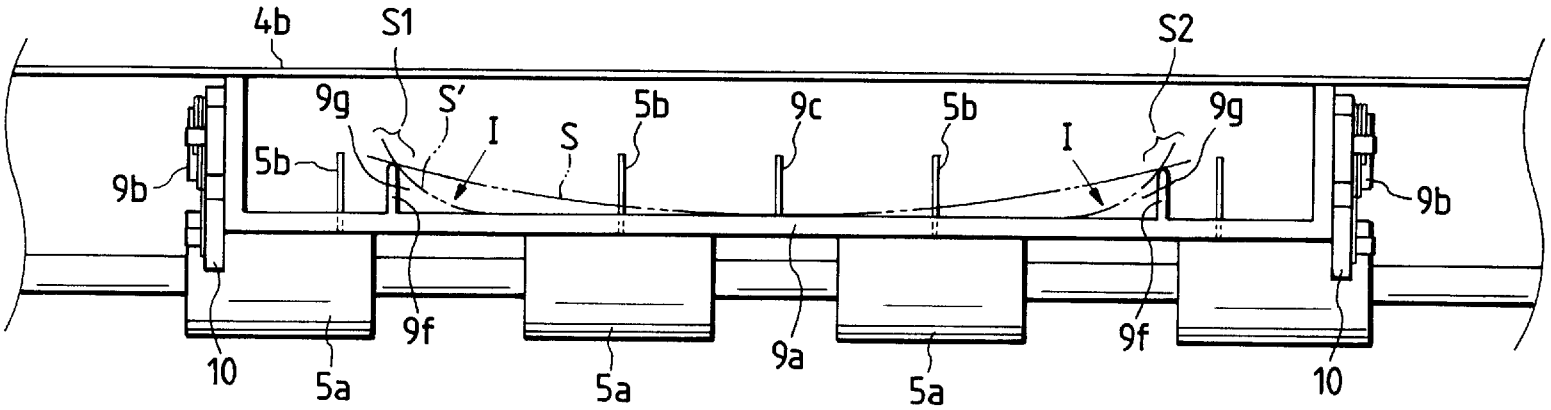
FIG. 20 is a view of a support means according to the eighth embodiment of the present invention, looked at from a sheet discharging direction.
Figure 21:
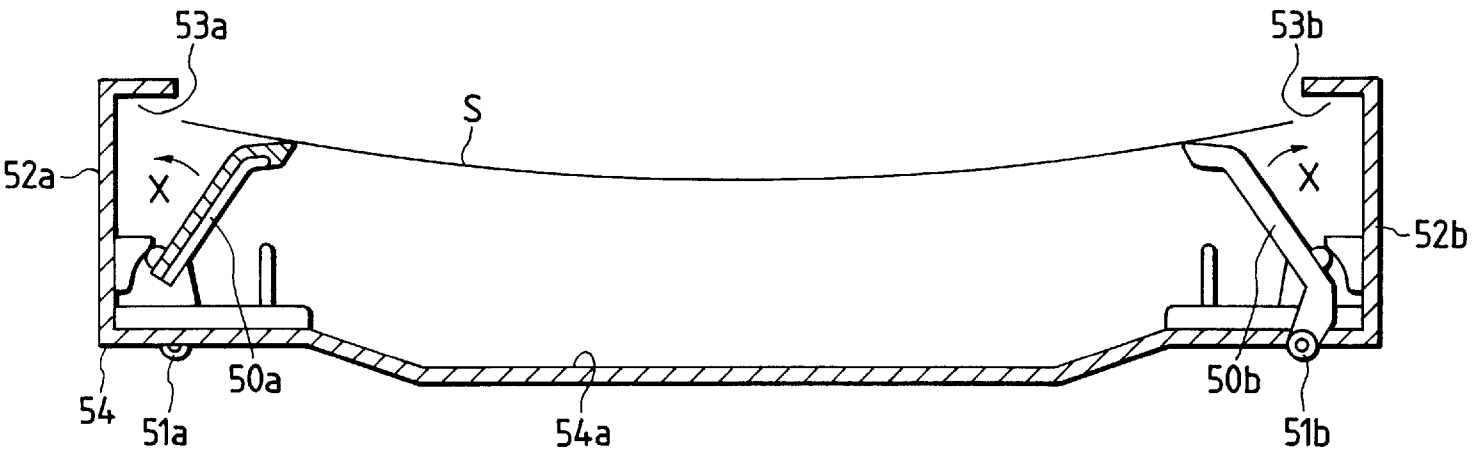
FIG. 21 RELATED ART
FIG. 21 is a sectional view showing a conventional technique.

Unlike to the sixth embodiment (FIG. 13) in which the sheet support surface of the support member 9*a* is continuously curved to provide the concave surface, in the support means according to the eighth embodiment, as shown in FIG. 20, ribs 9*f* are provided on the support member 9*a* in the vicinity of both end portions S1, S2 of the sheet S in the sheet width-wise direction.

With this arrangement, as shown in FIG. 20, as the sheet S is discharged, the sheet S supported by the support member 9*a* is gradually entered into escape spaces 9*g* (toward directions I) by its own weight while guiding the both end portions S1, S2 by means of the ribs 9*f*, with the result that the both end portions S1, S2 of the sheet S are curved with a smaller radius of curvature (condition shown by S' in FIG. 20).

Consequently, since the rigidity of the sheet S is increased, the sheet can be supported without suspending the tip end of the sheet downwardly, as is in the aforementioned embodiments. Also in this case, the entire apparatus does not become bulky and various sheets can be handled.

[Other Embodiments]

In the above-mentioned first to eighth embodiments, while an example that the rigidity of the sheet S is increased by curving or bending the sheet to provide the concave surface(s) by means of the support member was explained, the sheet may be curved to provide convex surface(s). Further, in the above-mentioned embodiments, while an example that the sheet S is curved to provide the continuous concave surface having a radius of curvature was explained, the sheet may be curved to provide either concave or a convex surface defined by straight lines.

In the above-mentioned first to eighth embodiments, while an example that the two ribs are used to curve the sheet S was explained, the number of the ribs is not limited to two, but, three or more ribs having different height may be used to curve the sheet S. Further, in the eighth embodiment, while an example that two ribs are arranged in the vicinity of both end portions of the sheet in the sheet width-wise direction was explained, for example, a single rib may be provided in the vicinity of one of both end portions of the sheet and a curved surface (such as shown in the sixth and seventh embodiments) may be provided on the support member in the vicinity of the other end portion of the sheet (combination of rib and concave surface) to increase the rigidity of the sheet.

Further, in the above-mentioned embodiments, an example that the ink jet recording head is used as the recording means was explained. The reason is that the usage of the support means according to the embodiments of the present invention is most effective to prevent the distortion of the ink image formed by the ink jet recording head. Therefore, of course, other recording heads such as an electrophotographic recording head, a heat-transfer recording head and the like can be used.

In the above-mentioned first embodiment, while an example that the sheet convey means 3 and the sheet discharge means 5 are constituted by the rollers was explained, these means may be constituted by rotating belts for applying a conveying force to the sheet. Lastly, in the above-mentioned first embodiment, while an example that the sheet convey means 3 and the sheet discharge means 5 are provided independently was explained, the sheet convey means and the sheet discharge means may be integrally constituted by using a common roller and the like.

What is claimed is:

1. An image forming apparatus in which an imaged sheet is discharged onto a stacking portion, comprising:

a recording means for forming an image on a sheet;

a discharge means for discharging the sheet on which the image was formed by said recording means onto said stacking portion;

a support means disposed downstream of said discharge means in a sheet discharging direction along a width-wise direction of the discharging sheet for supporting one surface of the sheet; and a shift means for shifting said support means between a support position to support the discharging sheet above said stacking portion and a retard position to allow stacking of the sheet onto said stacking portion;

wherein said shift means rocks said support means in an up-and-down direction around an axis crossing with the sheet discharging direction between the support position and the retard position.

2. An image forming apparatus according to claim 1, wherein said support means supports the sheet while bending them in a concave or convex shape along the width-wise direction of the sheet.

3. An image forming apparatus according to claim 2, wherein said support means has a plurality of ribs for bending and supporting the sheet.

4. An image forming apparatus according to claim 2, wherein said support means has a plurality of rollers for bending and supporting the sheet.

5. An image forming apparatus according to claim 2, wherein said support means has a hand-drum shaped rotary member for bending and supporting the sheet.

6. An image forming apparatus according to claim 2, further comprising a biasing means for biasing the sheet supported by said support means toward a bending direction.

7. An image forming apparatus according to claim 6, wherein said biasing means is a rotary member for biasing the sheet and capable of rotating in response to conveyance of the sheet.

8. An image forming apparatus according to claim 1, wherein said support means has one or more concave or convex surfaces disposed along the width-wise direction of the sheet.

9. An image forming apparatus according to claim 1, wherein said support means is provided at its both ends thereof with ribs for bending the sheet in a concave shape having a vertex at its central portion.

10. An image forming apparatus according to claim 1, wherein said support means has a curved surface for bending the sheet in a concave shape having a vertex at its central portion.

11. An image forming apparatus according to claim 1, wherein said shift means is controlled by a drive source different from a drive source for said discharge means.

12. An image forming apparatus according to claim 1, wherein a length of said support means is shorter than a height between said stacking portion and said discharge means so that, when said support means is lowered, said support means is positioned above said stacking portion.

13. An image forming apparatus according to claim 12, wherein the rocking of said support means is effected between a substantially horizontal position and a substantially downward vertical position.

14. An image forming apparatus according to claim 13, wherein the sheet is discharged onto said stacking portion with an imaged surface facing upside, and a non-imaged surface of the sheet is supported by said support means.

15. An image forming apparatus according to claim 1, wherein said support means is constituted by a rotatable belt which is cut away by about a half of an entire peripheral length of the belt in a longitudinal direction and by an amount greater than the width of the sheet in a width-wise direction.

16. An image forming apparatus according to claim 15, wherein said rotatable belt has a sheet bending means and can be rotated in a sheet conveying direction.

17. An image forming apparatus according to claim 15, wherein said rotatable belt has a sheet bending means and can be rotated in a sheet width-wise direction.

18. An image forming apparatus according to claim 1, wherein said shift means is operated by a driving force for said discharge means.

19. An image forming apparatus according to claim 18, wherein said shift means receives the driving force by contacting with said discharge means.

20. An image forming apparatus according to claim 19, wherein said discharge means has a discharge roller so that said shift means is reciprocally shifted by normal and reverse rotations thereof.

21. An image forming apparatus according to claim 20, wherein said shift means and said support means are constituted via an elastic member.

22. An image forming apparatus according to claim 18, wherein said support means supports the sheet while bending them in a concave or convex shape along the width-wise direction of the sheet.

23. An image forming apparatus according to claim 22, wherein said support means has a plurality of ribs for bending and supporting the sheet.

24. An image forming apparatus according to claim 22, further comprising a biasing means for biasing the sheet supported by said support means toward a bending direction.

25. An image forming apparatus according to claim 24, wherein said biasing means is a rotary member for biasing the sheet and capable of rotating in response to conveyance of the sheet.

26. An image forming apparatus according to claim 18, wherein said support means has one or more concave or convex surfaces disposed along the width-wise direction of the sheet.

27. An image forming apparatus according to claim 18, wherein said support means is provided at its both ends thereof with ribs for bending the sheet in a concave shape having a vertex at its central portion.

28. An image forming apparatus according to claim 18, wherein said support means has a curved surface for bending the sheet in a concave shape having a vertex at its central portion.

29. An image forming apparatus according to claim 18, a length of said support means is shorter than a height between said stacking portion and said discharge means so that, when said support means is lowered, said support means is positioned above said stacking portion.

30. An image forming apparatus according to claim 29, wherein the rocking of said support means is effected between a substantially horizontal position and a substantially downward vertical position.

31. An image forming apparatus according to claim 30, wherein the sheet is discharged onto said stacking portion with an imaged surface facing upside, and a non-imaged surface of the sheet is supported by said support means.

32. An image forming apparatus according to claim 1, wherein said stacking portion is formed within the image forming apparatus, the stacking portion has an extension tray which can be extended out of the apparatus, and said support means can be shifted within the apparatus.

33. An image forming apparatus according to claim 1, wherein said recording means is of ink jet recording type for effecting the recording by discharging ink in response to a signal.

34. An image forming apparatus according to claim 33, wherein said recording means discharges the ink from a discharge opening by utilizing film-boiling of the ink generated by thermal energy applied to an electrical/thermal converter.

* * * * *

UNITED STATES PATENT AND TRADEMARK OFFICE

CERTIFICATE OF CORRECTION

PATENT NO. : 5,890,822

DATED : April 6, 1999

INVENTOR(S) : SATOSHI SAIKAWA, ET AL.

It is certified that error appears in the above-identified patent and that said Letters Patent is hereby corrected as shown below:

COVER PAGE AT ITEM [56] REFERENCES CITED,
Foreign Patent Documents, "1235657" should read --1-235657--.

COVER PAGE AT ITEM [57] ABSTRACT,
Line 5, "means" should read --device--.

COLUMN 2,
Line 4, "line" should read --have--; and
Line 13, "rising" should read --arising--.

COLUMN 4,
Line 29, "the" should be deleted.

COLUMN 7,
Line 31, "thin" should be deleted.

COLUMN 8,
Line 48, "is" should be deleted;
Line 52, "Thus, since" should read --Since--; and
Line 54, "not to" should read --it does not--.

COLUMN 9,
Line 12, "is" should be deleted.

UNITED STATES PATENT AND TRADEMARK OFFICE

CERTIFICATE OF CORRECTION

PATENT NO. : 5,890,822

DATED : April 6, 1999

INVENTOR(S) : SATOSHI SAIKAWA, ET AL.

It is certified that error appears in the above-identified patent and that said Letters Patent is hereby corrected as shown below:

COLUMN 10,
Line 1, "re-started," should read --restarted,--.

COLUMN 11,
Line 8, "is" should be deleted; and
Line 20, "either" should read --either a--.

COLUMN 12,
Line 8, "them" should read --the sheet--.

COLUMN 13,
Line 13, "them" should read --the sheet--.

COLUMN 14,
Line 4, "claim 18," should read --claim 18, wherein--.

Signed and Sealed this

Thirtieth Day of November, 1999

*Attest:*

*Attesting Officer*

Q. TODD DICKINSON

*Acting Commissioner of Patents and Trademarks*